US007280089B2

(12) United States Patent
Moon

(10) Patent No.: US 7,280,089 B2
(45) Date of Patent: Oct. 9, 2007

(54) APPARATUS AND METHOD FOR DRIVING FIELD EMISSION DISPLAY DEVICE

(75) Inventor: Seong-Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 188 days.

(21) Appl. No.: 11/069,944

(22) Filed: Mar. 3, 2005

(65) Prior Publication Data

US 2005/0194911 A1 Sep. 8, 2005

(30) Foreign Application Priority Data

Mar. 5, 2004 (KR) ..... 10-2004-0015142
Mar. 11, 2004 (KR) ..... 10-2004-0016632

(51) Int. Cl.
*G09G 3/20* (2006.01)

(52) U.S. Cl. ..... 345/75.2; 345/204; 345/210; 315/169.1; 315/169.3

(58) Field of Classification Search ..... 345/75.2, 345/76–78, 98, 99, 204, 208, 210, 213, 214; 315/169.1, 169.3; 313/491, 492, 494–497; 257/10

See application file for complete search history.

(56) References Cited

U.S. PATENT DOCUMENTS

| | | | | |
|---|---|---|---|---|
| 5,578,900 | A * | 11/1996 | Peng et al. | 313/495 |
| 5,594,305 | A * | 1/1997 | Primm et al. | 315/169.3 |
| 6,133,893 | A * | 10/2000 | Maslennikov et al. | 345/74.1 |
| 6,169,372 | B1 * | 1/2001 | Kobayashi et al. | 315/169.3 |
| 6,646,282 | B1 * | 11/2003 | Chen | 257/10 |
| 6,672,926 | B2 * | 1/2004 | Liu et al. | 445/51 |
| 6,841,946 | B2 * | 1/2005 | Suzuki et al. | 315/169.1 |
| 2004/0155839 | A1 * | 8/2004 | Moon | 345/75.2 |

* cited by examiner

*Primary Examiner*—Haissa Philogene
(74) *Attorney, Agent, or Firm*—Ked & Associates, LLP

(57) ABSTRACT

An apparatus and method for driving a field emission display (FED) device are disclosed. By applying a voltage to a specific electrode (data electrode or mesh electrode) of the FED device during a blanking time of a display frame of an FED, electric charges unnecessarily charged in the FED device can be removed.

20 Claims, 5 Drawing Sheets

APPARATUS AND METHOD FOR DRIVING FIELD EMISSION DISPLAY DEVICE

BACKGROUND OF THE INVENTION

1. Field of the Invention

The present invention relates to a field emission display (FED) and, more particularly, to an apparatus and method for driving an FED device.

2. Description of the Conventional Art

Recently, demands on displays are increasing according to the rapid development of information communication technologies and the structures of displays are variably changing. For example, in an environment requiring mobility, a mobile information communication device such as a light, small and low power-consuming display is required, while when the display is used as a typical information conveying medium, a display with a large screen such as a CRT (Cathode Ray Tube), an LCD (Liquid Crystal Display), a PDP (Plasma Display Panel), a VFD (Vacuum Fluorescent Display) is required. Thus, the development for FEDs that can provide high resolution as well as having a reduced size and power consumption are being actively pursed.

The FED is receiving attention as a flat panel display for supporting next-generation information communications as it overcomes many shortcomings of currently developed or mass-produced flat panel displays (e.g., LCDs, PDPs, VFDs, etc.). The FED device has a simple electrode structure, can be operated at high speed such as the CRT, and has the advantage of being able to display a wide variety of colors, gray scale tones and provides high luminance.

Recently, FED devices having carbon nano tubes (CNTs) are being commonly used. The CNT is mechanically strong, chemically stable and has excellent in electron emission characteristics at a low degree of vacuum. By having a relatively small diameter (approximately 1.0~scores of nm), the CNT has a superior field enhancement factor when compared with an emitter having a micro tip, and thus can emit electrons at low turn-on electric fields (approximately 1.0~5.0V/μm). Thus, by applying the CNT to an FED device, a power loss and production unit cost of the FED device can be reduced.

A structure of the FED device having the CNT will now be described with reference to FIG. 1.

FIG. 1 is a sectional view showing the structure of a general FED device.

As shown in FIG. 1, a conventional FED device includes an upper glass substrate 10; an anode electrode 11 formed on the upper glass substrate 10; a phosphor layer 12 formed on the anode electrode 11; a lower glass substrate 1; a gate electrode 2 formed on the lower glass substrate 1; an insulation layer 3 formed on the gate electrode 2; a cathode electrode 5 formed on the insulation layer 3; a CNT (Carbon Nano Tube) 6 formed on the cathode electrode 5; and a counter electrode 4 electrically connected with the gate electrode 2 exposed through a via hole of the insulation layer 3 and formed on the same plane with the cathode electrode 5. The upper glass substrate 10 and the lower glass substrate 1 are disposed at the opposite side with a certain interval therebetween.

In order to drive the FED device, when a high voltage is applied to the anode electrode and a low voltage is applied to the gate electrode 2 and to the cathode electrode 5, electrons are emitted from the CNT 6, accelerated by the high field of the anode electrode 11, and then collide with the phosphor layer 12.

Since the counter electrode 4 and the cathode electrode 5 are formed on the same plane, electrons emitted from the CNT 6 move toward the counter electrode 4 and then move toward the phosphor layer 12 by the high field of the anode electrode 11.

However, since the high voltage applied to the anode electrode 11 affects the CNT 6, electron beams can be easily distorted to degrade the display quality and cross talk (interference) is caused among neighboring cells due to the distorted electron beams.

Therefore, in order to prevent the distortion of electron beams and concentrate electron beams into the cell, a mesh electrode is additionally formed.

FIG. 2 is a sectional view of an FED device having a mesh electrode in accordance with the conventional art.

As shown in FIG. 2, the FED device having a mesh electrode includes: an upper glass substrate 110; an anode electrode 100 formed on the upper glass substrate 110; a lower glass substrate 15; a conductive layer 20 formed on the lower glass substrate 15; an insulation layer 30 formed on the conductive layer 20; a cathode electrode 40 formed on the insulation layer 30; a CNT 50 formed on or near the cathode electrode 40; a gate electrode 25 electrically connected with the conductive layer 20 exposed through a via hole of the insulation layer 30; and mesh electrodes 70 supported by structures 60 formed on the cathode electrode 40 and on the gate electrode 25. The upper glass substrate 110 and the lower glass substrate 15 are disposed with a spacer 80 therebetween at a certain interval in a facing manner.

The structures 60 are made of glass, and the mesh electrodes 70 are formed on the structures 60. The mesh electrodes 70 are disposed at an upper side of the gate electrode 25 and the cathode electrode 40, thereby spreading and distortion of electron beams can be prevented.

When a high voltage is applied to the anode electrode 100 and a low voltage is applied to the cathode electrode 40, electrons are emitted from the CNT 50. At this time, a fixed amount of DC voltage is applied to the mesh electrodes 70.

The mesh electrodes 70 shields electric field generated by the anode electrode 100 so that the high voltage applied to the anode electrode 100 cannot affect the gate electrode 25 and the cathode electrode 40. Thus, electrons emitted from the CNT 50 are accelerated by the voltage applied to the mesh electrodes 70 and proceed toward the mesh electrodes 70. After passing through the mesh electrodes 70, electrons are accelerated by the anode electric field, and then, collide with the phosphor layer 90. Namely, the mesh electrodes 70 serve to concentrate electron beams into the cell.

However, since the insulation layer 30 with a dielectric component is positioned between the gate electrode 25 and the cathode electrode 40, electric charges are charged in the insulation layer 30, and as the electrons emitted from the CNT 50 collide with the mesh electrodes 70, electric charges are also charged not only in the mesh electrodes 70 but also in the structures 60 supporting the mesh electrodes 70, causing a problem that electron beams are distorted, and thus a leakage current is increased to increase power consumption.

In addition, it is difficult to drive the FED device due to the high voltage because of the electric charges charged in the insulation layer 30, the mesh electrodes 70 and the structures 60 supporting the mesh electrodes 70, and thus, the luminance of the FED deteriorates.

As mentioned above, the FED device has the following problems.

That is, since the electric charges are charged in the insulation layer of the FED device, electron beams are distorted.

In addition, since the electric charges are charged in the mesh electrodes and in the structures for supporting the mesh electrodes, a leakage current increase, and distortion of the electron beams causes cross talk (interference) among neighboring cells.

U.S. Pat. Nos. 6,169,372, 6,646,282 and 6,672,926 also disclose various conventional techniques of the FED device.

SUMMARY OF THE INVENTION

Therefore, one object of the present invention is to provide an apparatus and method for driving a field effect display (FED) device capable of preventing distortion of electron beams by removing electric charges charged in the insulation layer of an FED device.

Another object of the present invention is to provide an apparatus and method for driving a field effect display (FED) device capable of reducing a leakage current by removing electric charges charged in mesh electrodes and structures for supporting the mesh electrodes of the FED device and preventing cross talk (interference) between neighboring cells by preventing distortion of electron beams.

To achieve these and other advantages and in accordance with the purpose of the present invention, as embodied and broadly described herein, there is provided a method for driving a field effect display (FED) device including: applying a voltage to a specific electrode of an FED device during a blanking time of a display frame of an FED.

To achieve the above objects, there is also provided a method for driving a field effect display (FED) device including: applying a positive voltage to a data electrode of the FED device during a display time of a display frame of an FED; and applying a lower voltage than the positive voltage to the data electrode during a blanking time of the display frame.

To achieve the above objects, there is also provided a method for driving a field effect display (FED) device including: applying a data pulse having a positive voltage to a data electrode of the FED device during a display time of the display frame of an FED and applying a scan pulse having a negative voltage in synchronization with the data pulse to a scan electrode of the FED device; and applying a lower pulse than the data pulse to the data electrode during a blanking time of the display frame.

To achieve the above objects, there is also provided a method for driving a field effect display (FED) device including: applying a data pulse having a positive voltage to a data electrode of the FED device and a scan pulse having a negative voltage synchronized with the data pulse to the scan electrode of the FED device during a display time of a display frame of an FED; applying a negative pulse having a negative voltage to the data electrode during a blanking time of the display frame in order to remove electric charge charged in an insulation layer of the FED device; applying a positive voltage to a mesh electrode of the FED device during a display time; and applying a lower voltage than a ground voltage to the mesh electrode during the blanking time in order to remove electric charges charged at the mesh electrode and on a structure supporting the mesh electrode. Herein, the mesh electrode is positioned on structures formed on the data electrode and the scan electrode.

To achieve the above objects, there is also provided an apparatus for driving a field effect display (FED) device including: a first driving unit for applying a voltage to a data electrode of the FED device during a blanking time of a display frame of an FED.

To achieve the above objects, there is also provided an apparatus for driving a field effect display (FED) device including: a data driving unit for applying a data pulse having a positive voltage to a data electrode of an FED device during a display time of a display frame of an FED and applying a negative pulse having a negative voltage to a data electrode during a blanking time of the display frame; a scan driving unit for applying a scan pulse having a negative voltage synchronized with the data pulse to a scan electrode of the FED device; and a first driving unit for applying a voltage not higher than a ground voltage to a mesh electrode during the blanking time. Herein, the mesh electrode is positioned on structures formed on the data electrode and the scan electrode.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

An apparatus and method for driving an FED device capable of removing electric charges unnecessarily charged in the FED device by applying a voltage lower than a ground voltage to a specific electrode (i.e., a data electrode and a mesh electrode) of the FED device during a blanking time of a display frame of an FED in accordance with a preferred embodiment of the present invention will be described with reference to FIGS. 3 to 9.

Figure 3:
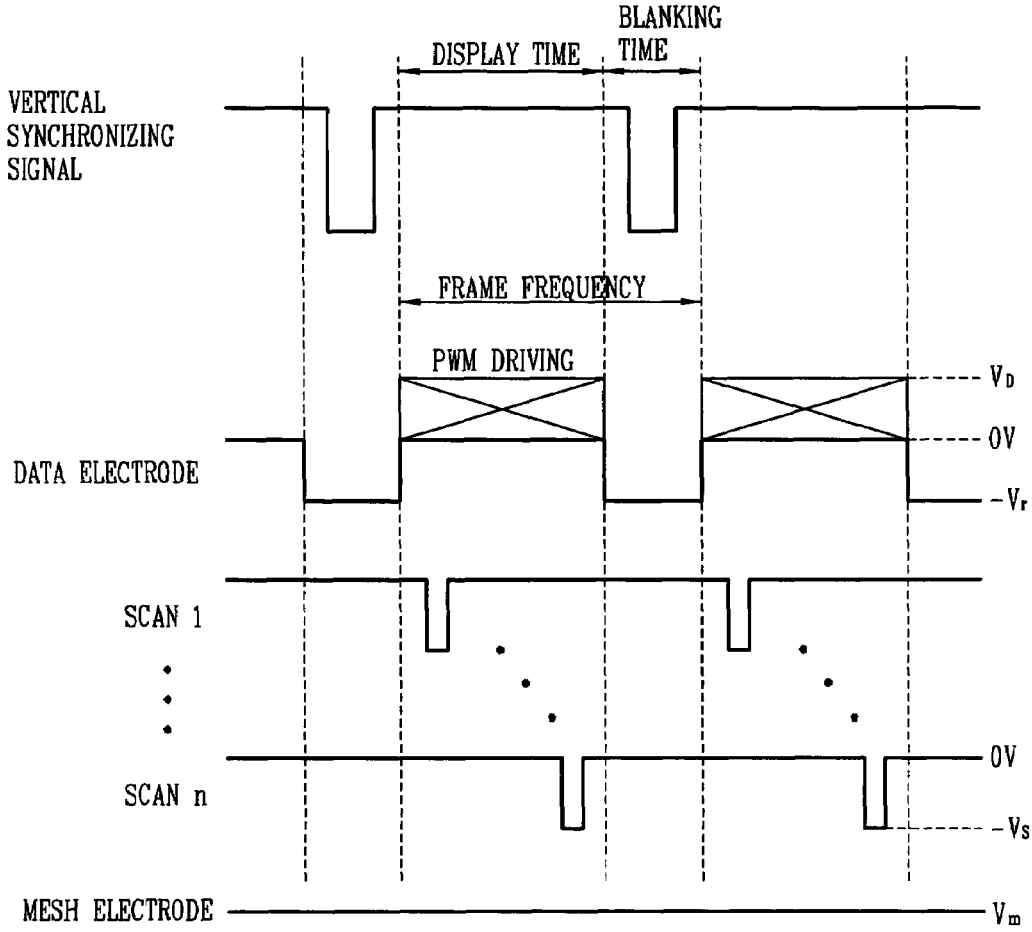
FIG. 3 shows pulses applied to an FED device in accordance with a first embodiment of the present invention.

FIG. 3 shows pulses applied to an FED device in accordance with a first embodiment of the present invention.

As shown in FIG. 3, as for a pulse applied based on a frame, a display unit of a screen, a vertical synchronizing signal, namely, one display frame (or frame frequency) includes a display time for displaying data on an FED and a blanking time for not displaying data.

During the display time, a scan pulse (−Vs) having a negative voltage is sequentially applied to scan electrodes (cathode electrode) (scan 1~scan n), and simultaneously, a data pulse having a positive voltage in synchronization with the scan pulse is applied to a data electrode (gate electrode) according to a PWM (Pulse Width Modulation) method, thereby displaying data on the FED.

After the display time elapses, a negative voltage (−Vr) is applied to the data electrode (gate electrode) during the blanking time in order to remove electric charges charged at the insulation layer of the FED device. Namely, by applying the negative voltage (−Vr) to the data electrode during the blanking time, electric charges charged in the insulation layer of the FED device can be removed, and thus, a flashover phenomenon generated due to the electric charges charged in the insulation layer would not occur.

Figure 4:
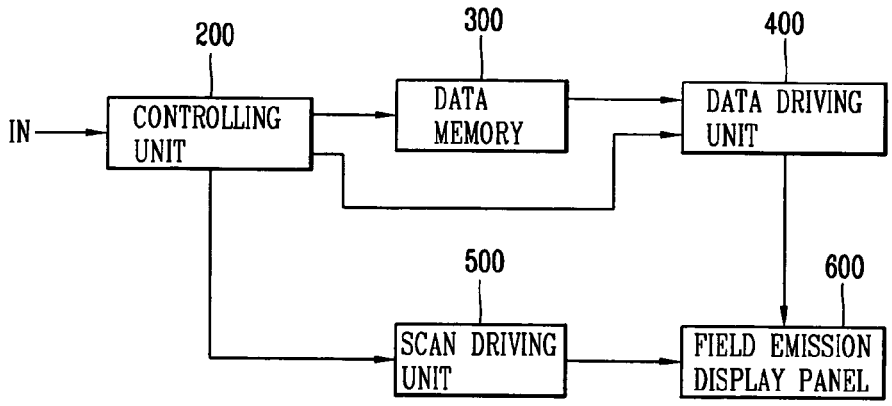
FIG. 4 is a block diagram showing a unit for driving the FED device in accordance with the first embodiment of the present invention.

FIG. 4 is a block diagram showing a unit for driving the FED device in accordance with the first embodiment of the present invention.

As shown in FIG. 4, an apparatus for driving an FED device includes a controlling unit 200 for receiving a video signal and a synchronizing signal (IN), storing data with respect to the video signal in a data memory 300, and outputting a control signal (i.e., a horizontal/vertical synchronizing signal); a data driving unit 400 for receiving the control signal from the controller 200 and outputting a data pulse which has been pulse-width-modulated; and a scan driving unit 500 for receiving a control signal from the controller 200 and outputting a scan pulse in synchronization with the data pulse. An FED panel 600 receives the data pulse and the scan pulse and displays the video signal.

The data driving unit 400 outputs a data pulse having a positive voltage (VD) to the data electrode during a display time for displaying the video signal and outputs a negative pulse having a negative voltage (−Vr) to the data electrode during a blanking time during a vertical synchronizing signal period under the control of the controller 200. Namely, in the present invention, after a scan pulse with respect to one frame is applied to all the scan electrodes (scan 1~scan n) of the FED panel 600, the negative pulse having the negative voltage (−Vr) is applied to all the data electrodes (gate electrodes) of the FED panel 600 during the blanking time of the vertical synchronizing signal to remove electric charges charged in the insulation layer.

Figure 5:
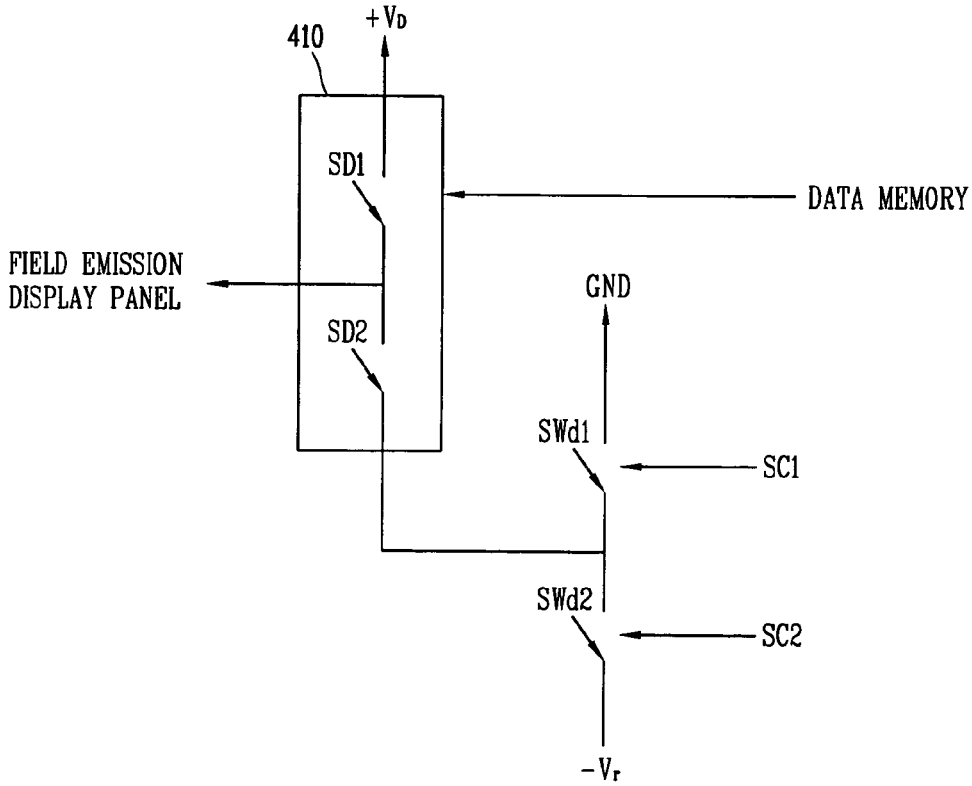
FIG. 5 is a detailed circuit diagram of a data driving unit of FIG. 4.

FIG. 5 is a detailed circuit diagram of a data driving unit of FIG. 4, that is, a partial circuit of the data driving unit connected with one data electrode of the FED panel. The circuit of the data driving unit can be changed variably.

As shown in FIG. 5, the data driving unit 400 includes a plurality of switching units SWd1 and SWd2 for outputting the negative voltage (−Vr) or the ground voltage (GND) by control signals SC1 and SC2 outputted from the controlling unit 200; and a data driving IC 410 including a plurality of switching units SD1 and SD2 outputting the positive voltage $+V_D$ or a voltage (ground voltage or −Vr) outputted by the switching units SWd1 and SWd2 to the data electrodes (gate electrodes) of the display panel 600 according to the control signals SC1 and SC2 outputted from the controlling unit 200.

The plurality of switching units SWd1 and SWd2 determine polarity of a s voltage applied to the data electrodes (gate electrodes) of the FED panel. In order to apply the negative pulse to the data electrode, the switching unit SD1 is turned off, the switching unit SWd1 is turned off, and then, the switching unit SWd2 is turned on. Then, the data driving IC 410 outputs a negative pulse of a negative voltage to the data electrode. At this time, the switching unit SWd2 is turned on during the blanking time of the vertical synchronizing signal (or one frame) under the control of the controller 200 to output the negative pulse to the data electrode.

Accordingly, the data driving unit can apply the positive pulse with the positive voltage to the data electrode of the FED panel during the display time for displaying data with respect to the video signal stored in the data memory and apply the negative pulse with the negative voltage to the data electrode during the blanking time, thereby removing electric charges charged in the insulation layer of the FED device.

Figure 1:
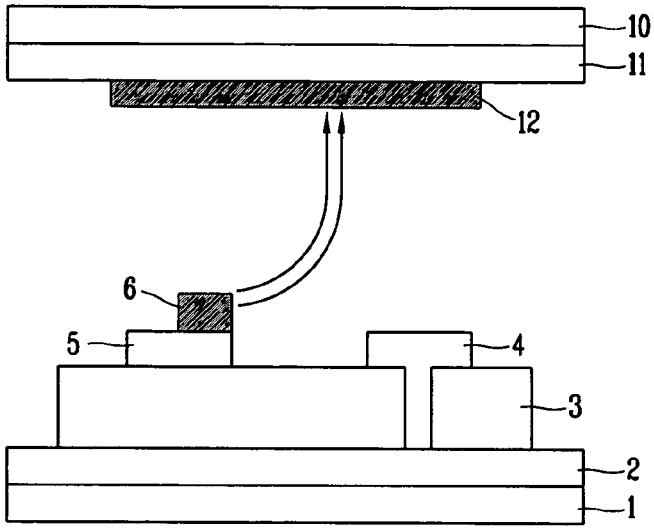
FIG. 1 CONVENTIONAL ART
FIG. 1 is a sectional view showing the structure of a field effect display (FED) in accordance with a conventional art.
Figure 2:
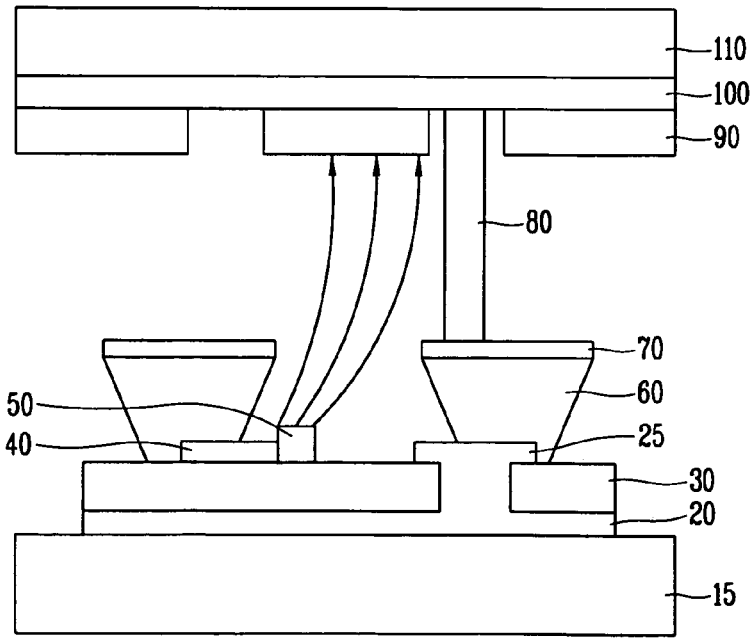
FIG. 2 CONVENTIONAL ART
FIG. 2 is a sectional view showing the structure of an FED having a mesh electrode in accordance with the conventional art.

In addition, electric charges charged in the mesh electrode and in the structure supporting the mesh electrode can be removed by applying the ground voltage or the negative voltage to the mesh electrode (reference numeral 70 of FIG. 2).

A method for driving the FED capable of removing electric charges charged in the mesh electrode and the structure supporting the mesh electrode by applying a voltage lower than the ground voltage will be now be described.

Figure 6:
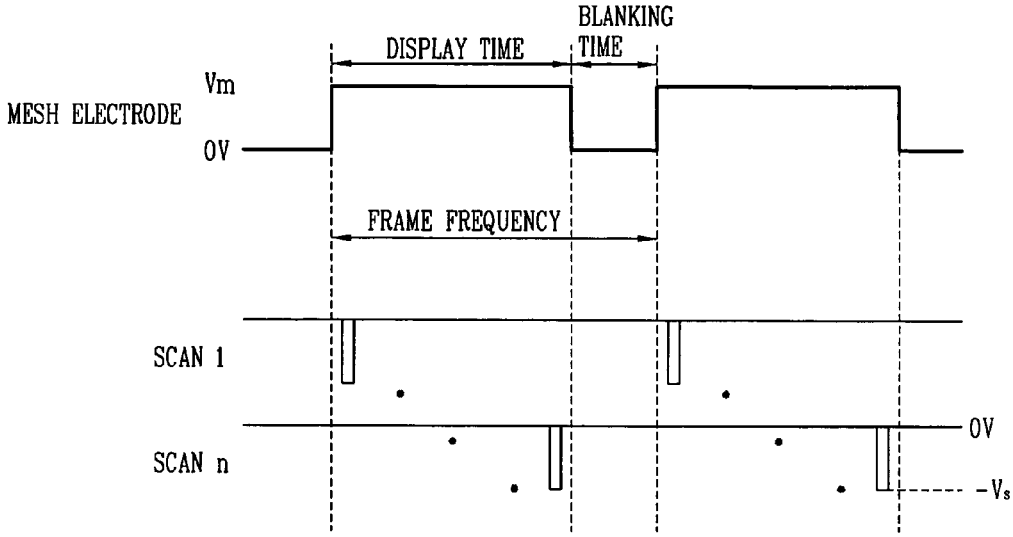
FIG. 6 shows a pulse for driving an FED in accordance with a second embodiment of the present invention.

FIG. 6 shows a pulse for driving an FED in accordance with a second embodiment of the present invention.

As shown in FIG. 6, a scan pulse with a negative voltage is sequentially applied to the scan electrodes (cathode electrodes) (scan 1~scan n) during the display time and a data pulse with a positive voltage in synchronization with the scan pulse is applied to the data electrodes (gate electrodes), to display data on the FED. At this time, a positive voltage is applied to the mesh electrode during the display time.

Thereafter, in order to remove electric charges charged in the mesh electrode of the FED device during the display time, the ground voltage or the negative voltage (i.e., −Vr) is applied to the mesh electrode during the blanking time. Namely, by applying a voltage not higher than the ground voltage to the mesh electrode during the blanking time, electric charges charged in the mesh electrode and the structure (made of glass) supporting the mesh electrode can be removed, and thus, a leakage current through the mesh electrode can be reduced.

When the positive voltage is applied to the mesh electrode during the display time, electrons emitted from the CNT are accelerated toward the direction of the mesh electrode, some electrons collide with the mesh electrode and the structure supporting the mesh electrode and are charged in the mesh electrode and the structure supporting the mesh electrode. Thus, the voltage not higher than the ground voltage is applied to the mesh electrode during the blanking time to remove the charged electric charges.

By doing that, a current leaked through the mesh electrode can be reduced, the luminance of the FED can be enhanced, and distortion of electron beams and cross talk (interference) among the neighboring cells can be prevented. In addition, because electric charges are not charged in the FED device, a high voltage can be applied to the FED device and thus the luminance of the FED can be enhanced.

Figure 7:
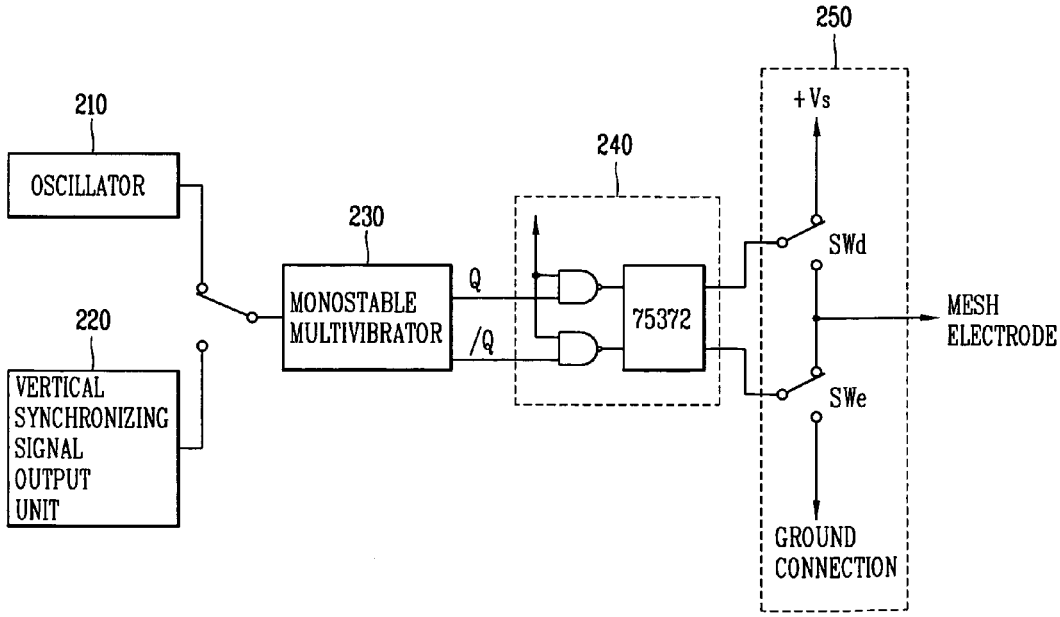
FIG. 7 is a block diagram of a driving unit for applying a pulse to a mesh electrode in accordance with the second embodiment of the present invention.

FIG. 7 is a block diagram of a driving unit for applying a pulse to a mesh electrode in accordance with the second embodiment of the present invention. The driving unit for applying the positive voltage (pulse) or the ground voltage to the mesh electrode can be changed variably and have various structures.

As shown in FIG. 7, the driving unit includes: a vertical synchronizing signal output unit 220 for outputting a vertical synchronizing signal according to a frame frequency; a monostable multivibrator 230 for generating a pulse in synchronization with the vertical synchronizing signal; an inverter/level converter 240 for inverting a signal of a pulse outputted from the monostable multivibrator 230, changing a level of the inverted signal, and outputting the level-changed signal as a switch drive signal; and a switching unit 250 for outputting a positive voltage (+Vs) according to the switch drive signal or outputting a ground voltage (or a negative voltage according to a structure of a circuit).

The vertical synchronizing signal output unit 220 can output a used vertical synchronizing signal as it is in order to output a video signal, or can obtain a vertical synchronizing signal from a processor (not shown) for providing the video signal.

An oscillator 210 for oscillating a signal corresponding to the vertical synchronizing signal can be used instead of the vertical synchronizing signal output unit 220.

Figure 8:
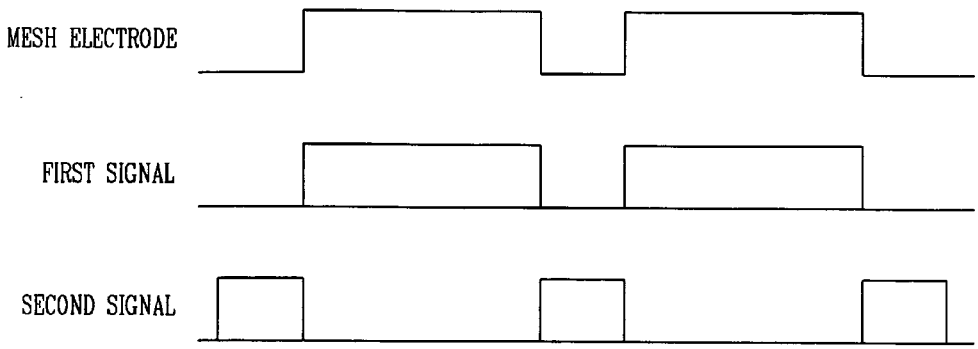
FIG. 8 shows waveforms of an output signal applied to the mesh electrode from the driving unit of FIG. 7 and of operation signals of switching units for generating the output signal.

FIG. 8 shows waveforms of an output signal applied to the mesh electrode from the driving unit of FIG. 7 and of operation signals of switching units for generating the output signal.

As shown in FIG. 8, a voltage applied to the mesh electrode can be provided in a pulse form according to the frame frequency, and while a first signal is applied to a first switch SWd of the switch unit 250, a positive voltage is applied to the mesh electrode, and while a second signal is applied to the second switch SWe, the ground voltage is applied to the mesh electrode.

Figure 9:
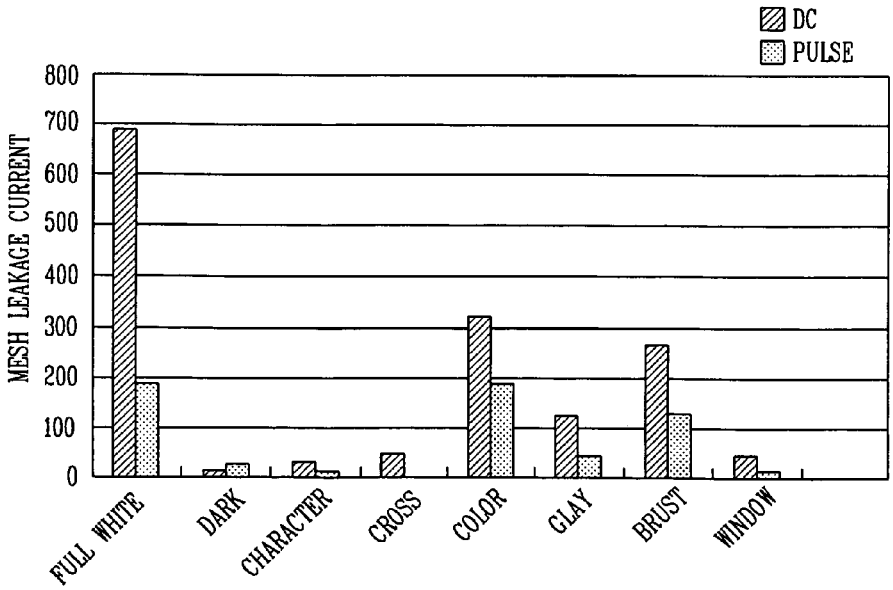
FIG. 9 shows a difference between a current leaked when a pulse is applied to the mesh electrode in accordance with the second embodiment of the present invention and a current leaked through a mesh electrode when a DC voltage is applied to the mesh electrode in accordance with the conventional art.

FIG. 9 shows a difference between a current leaked when a pulse is applied to the mesh electrode in accordance with the second embodiment of the present invention and a current leaked through a mesh electrode when a DC voltage is applied to the mesh electrode in accordance with the conventional art.

As shown in FIG. 9, in case where color (full W) is displayed entirely on the FED, the mesh electrode driving method of the present invention can considerably reduce the leakage current compared with the conventional art. In addition, in case where various patterns are displayed on the FED, the mesh electrode driving method of the present invention can considerably reduce the mesh leakage current compared to the conventional art.

In the present invention, a voltage lower than the voltage applied to the data electrode and/or the mesh electrode of the FED device during the display time of the display frame of the FED is applied to the data electrode and/or the mesh electrode during the blanking time of the display frame of the FED, whereby the electric charges charged in the insulation layer of the FED device can be removed and also the electric charges charged in the mesh electrode and the structure supporting the mesh electrode can be removed.

As so far described, the method for driving the FED device of the present invention has many advantages.

That is, for example, first, by applying the negative voltage to the data electrodes (gate electrodes) during the blanking time, electric charges charged in the insulation layer of the FED device can be removed, a flashover phenomenon can be also removed, and distortion of electron beams can be prevented.

Second, by applying a voltage not higher than a ground voltage to the mesh electrode during the blanking time, electric charges charged in the mesh electrode and the structure supporting the mesh electrode of the FED device can be removed.

Third, by removing electric charges charged in the mesh electrode and in the structure supporting the mesh electrode during the blanking time, a current leaked to the mesh electrode can be considerably reduced to reduce power consumption, and distortion of electron beams can be also prevented.

Fourth, because electric charges are not charged in the FED device, a high voltage can be applied to the FED device, and thus, the luminance of the FED can be enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for driving a field emission field (FED) device comprising:

applying a negative voltage to a specific electrode of the FED device during a blanking time of a display frame of an FED.

2. The method of claim 1, wherein the negative voltage is lower than a voltage applied to the specific electrode during a display time of the display frame of the FED.

3. The method of claim 2, wherein the lower voltage is a lower pulse.

4. The method of claim 1, wherein the specific electrode is a data electrode.

5. The method of claim 4, wherein the negative voltage is a negative pulse and the negative pulse is applied to the data electrode.

6. The method of claim 1, wherein the specific electrode is a mesh electrode positioned on structures formed on a data electrode and a scan electrode of the FED device.

7. The method of claim 6, wherein the negative voltage is a pulse not higher than a ground voltage and the pulse is applied to the mesh electrode.

8. A method for driving a field emission display (FED) device comprising:

applying a positive voltage to a data electrode of the FED device during a display time of a display frame of an FED; and applying a negative voltage lower than the positive voltage to the data electrode during a blanking time of the display frame.

9. The method of claim 8, wherein the negative voltage applied to the data electrode during the blanking time is a negative pulse.

10. The method of claim 8, further comprising:

applying a voltage to the mesh electrode of the FED device during the blanking time, wherein the mesh electrode is positioned on structures formed on the data electrode and a scan electrode of the FED device and the voltage applied to the mesh electrode during the blanking time is lower than the voltage applied to the mesh electrode during the display time.

11. The method of claim 10, wherein the voltage applied to the mesh electrode during the blanking time is a pulse not higher than a ground voltage.

12. A method for driving a field emission display (FED) device comprising:

applying a data pulse having a positive voltage to a data electrode of the FED device during a display time of the a display frame of an FED and applying a scan pulse having a negative voltage in synchronization with the data pulse to a scan electrode of the FED device; and applying a negative pulse lower than the data pulse to the data electrode during a blanking time of the display frame.

13. The method of claim 12, wherein the negative pulse is applied to the data pulse in order to remove electric charges charged in an insulation layer of the FED device.

14. The method of claim 12, further comprising:

applying a positive voltage to a mesh electrode of the FED during the display time; and applying a voltage lower than the positive voltage to the mesh electrode during the blanking time, wherein the mesh electrode is positioned on structures formed on the data electrode and the scan electrode.

15. The method of claim 14, wherein applying the lower voltage to the mesh electrode includes applying the lower voltage to the mesh electrode in order to remove electric charges charged in the mesh electrode and the structures supporting the mesh electrode.

16. A method for driving a field emission display (FED) device comprising:

applying a data pulse having a positive voltage to a data electrode of the FED device and a scan pulse having a negative voltage synchronized with the data pulse to a scan electrode of the FED device during a display time of a display frame of an FED;

applying a negative pulse having a negative voltage to the data electrode during a blanking time of the display frame in order to remove electric charges charged in an insulation layer of the FED device;

applying a positive voltage to a mesh electrode of the FED device during a display time; and applying a lower voltage than a ground voltage to the mesh electrode during the blanking time in order to remove electric charges charged at the mesh electrode and on a structure supporting the mesh electrode, wherein the mesh electrode is positioned on structures formed on the data electrode and the scan electrode.

17. An apparatus for driving a field emission display (FED) device comprising:

a first driving unit for applying a negative voltage to a data electrode of the FED device during a blanking time of a display frame of an FED.

18. The apparatus of claim 17, wherein the negative voltage is lower than the voltage applied to data electrode during a display time of the display frame of the FED.

19. The apparatus of claim 17, further comprising:

a second driving unit for applying a voltage, which is lower than the voltage applied to a mesh electrode of the FED during a display time of the display frame of the FED, to the mesh electrode during the blanking time, wherein the mesh electrode is positioned on structures formed on the data electrode and a scan electrode of the FED.

20. A field emission display (FED) device comprising:

a data driving unit for applying a data pulse having a positive voltage to a data electrode of the FED device during a display time of a display frame of an FED and applying a negative pulse having a negative voltage to a data electrode during a blanking time of the display frame;

a scan driving unit for applying a scan pulse having a negative voltage synchronized with the data pulse to a scan electrode of the FED device; and a first driving unit for applying a voltage not higher than a ground voltage to a mesh electrode during the blanking time, wherein the mesh electrode is positioned on structures formed on the data electrode and the scan electrode.

* * * * *